US008481437B2

(12) United States Patent
Greiner et al.

(10) Patent No.: US 8,481,437 B2
(45) **Date of Patent: *Jul. 9, 2013**

(54) THERMALLY BOUND NON-WOVEN MATERIAL

(75) Inventors: Armin Greiner, Weinheim (DE); Klaus Veeser, Weinheim (DE); Holger Schilling, Heitersheim (DE); Guenter Frey, Schliengen (DE); Ralph Berkemann, Moerlenbach (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/301,968

(22) Filed: Nov. 22, 2011

(65) Prior Publication Data

US 2012/0129032 A1 May 24, 2012

Related U.S. Application Data

(63) Continuation of application No. 11/910,575, filed as application No. PCT/EP2006/001992 on Mar. 4, 2006, now Pat. No. 8,124,550.

(30) Foreign Application Priority Data

Apr. 4, 2005 (DE) ..... 10 2005 015 550

(51) Int. Cl.
*B32B 5/14* (2006.01)
*D04H 13/00* (2006.01)

(52) U.S. Cl.
USPC ..... 442/364; 210/500.1; 428/212; 428/213; 428/219; 442/327; 442/333

(58) Field of Classification Search
USPC 210/500.1; 428/190, 212, 213, 219; 442/327, 442/333, 364
See application file for complete search history.

(56) References Cited

U.S. PATENT DOCUMENTS 3,589,956 A * 6/1971 kranz et al. ..... 264/115
8,124,550 B2 * 2/2012 Greiner et al. ..... 442/364

OTHER PUBLICATIONS

Jue et al., Polymer Engineering and Science, Feb. 2004, vol. 44, No. 2, pp. 331-344.*

* cited by examiner

*Primary Examiner* — John Kim
(74) *Attorney, Agent, or Firm* — Grossman, Tucker, Perreault & Pfleger, LLC

(57) ABSTRACT

The invention relates to a thermally bound non-woven material containing a low-shrinkage dual-component core-sheath fiber consisting of a crystalline polyester core and a crystalline polyester sheath which has a melting point at least 10° C. lower than the core, the heat-shrinkage characteristic of said fiber being less than 10% at 170° C.

10 Claims, 7 Drawing Sheets

THERMALLY BOUND NON-WOVEN MATERIAL

CROSS REFERENCE TO RELATED APPLICATIONS

This application is a continuation application of U.S. application Ser. No. 11/910,575 filed Jun. 16, 2008, now U.S. Pat No. 8,124,550, filed as application No. PCT/EP2006/001992 on Mar. 4, 2006. the teachings of which are incorporated herein by reference.

TECHNICAL FIELD

The invention relates to a thermally bonded nonwoven fabric having improved thermal and chemical stability. The invention further relates to uses of this nonwoven fabric.

PRIOR ART

Melt-bondable fibers and nonwoven fabrics produced therefrom are known from EP 0 340 982 B1. Melt-bondable fibers are dual-component fibers composed of a first, at least partially crystalline, polymer component and a second component, adhering to the surface of the first component, containing a compatible blend of polymers comprising at least one amorphous polymer and at least one polymer which is at least partially crystalline. The melting temperature of the second component is at least 30° C. below that of the first component, but is at least equal to or greater than 130° C. In addition, the weight ratio of the amorphous polymer of the second component to the at least partially crystalline polymer of the second component is in the range of 15:85 and 90:10, and has a value such that binding of dual-component fibers to a similar dual-component fiber is prevented, and the first component forms the core and the second component forms the sheath for a dual-component fiber spun in the form of a sheath-core configuration. This dual-component fiber is mixed with conventional polyester fibers and thermally bonded to produce a nonwoven fabric, which is processed into an abrasive fleece by application of abrasive particles.

Heat-bondable conjugate fibers are known from JP 07-034326 which have a sheath-core configuration, and have a core made of a polyester containing polyethylene terephthalate (PET) as the main component, and have a sheath that is produced from a copolymerized polyester or a side-by-side conjugate fiber composed of polyethylene terephthalate and a copolymerized polyester. The copolymerized polyester represents the lower-melting component, and contains butylene terephthalate units and butylene isophthalate units as repeating structural units. A nonwoven fabric produced from these dual-component fibers is designed to have excellent thermal resistance and fatigue resistance against pressure stress, so that it may be used as an alternative material for polyurethane seat coverings, primarily in the automotive sector.

Thermally bonded nonwoven fabrics may also be produced from a mixture of drawn and undrawn PET fibers. However, these nonwoven fabrics require bonding under heat and pressure in a calendar. The bonding capability of the undrawn amorphous PET fibers is based not on a melting process, but, rather, on the crystallization process for PET, which begins above 90° C. provided that crystallizable fractions are still present. Such nonwoven fabrics have high chemical and thermal stability. However, the production process permits little flexibility. Thus, for undrawn PET fibers, for example, it is not possible to activate the bonding capability multiple times, since this requires a process that is irreversible below the melting temperature. In addition, bonding of nonwoven fabrics having weights per unit area >150 g/m$^2$ with undrawn PET fibers is difficult, since in the calendaring process the external heat cannot penetrate sufficiently into the nonwoven web. A more or less pronounced gradient always occurs.

DESCRIPTION OF THE INVENTION

The object of the invention is to provide a thermally bonded nonwoven fabric having improved thermal stability properties, in particular the shrinkage tendency of the nonwoven fabrics obtained. In addition, the chemical stability is increased compared to fibers containing copolymers of monomer mixtures such as isophthalic acid/terephthalic acid.

The object is achieved according to the invention by use of a thermoplastically bonded nonwoven fabric containing a low-shrinkage dual-component core-sheath fiber. The low-shrinkage dual-component core-sheath fiber is composed of a crystalline polyester core and a crystalline polyester sheath which has a melting point at least 10° C. lower than the core, and has a hot-air shrinkage of less than 10%, preferably less than 5%, at 170° C. At temperature stresses of 150° C. (1 h), a corresponding nonwoven fabric exhibits a thermal dimensional change (shrinkage and curl) of less than 2%. In the context of the invention, the term "crystalline" means a polyester polymer having a heat of fusion (DSC) of >40 joule/g and a width of the melting peak (DSC) preferably occurring at <40° C. at 10° C./min.

The sheath of the low-shrinkage dual-component fiber is preferably composed of a homogeneous polyester polymer, produced from a monomer pair, of which greater than 95% is formed from a single polymer pair. In the case of the polyester described in the claims, this means that >95% of the polymer is composed of a single dicarboxylic acid and a single dialcohol.

The mass ratio of the core-sheath component is typically 50:50, but for specialty applications may vary between 90:10 and 10:90.

A nonwoven fabric is particularly preferred in which the sheath of the dual-component core-sheath fiber is composed of polybutylene terephthalate (PBT), polytrimethylene terephthalate (PTT), or polyethylene terephthalate (PET).

Further preferred is a nonwoven fabric in which the core of the low-shrinkage dual-component core-sheath fiber is composed of polyethylene terephthalate or polyethylene naphthalate (PEN).

The nonwoven fabric according to the invention may contain additional fibers besides the low-shrinkage dual-component core-sheath fiber, depending on the particular use. It is preferred to use 0 to 90% by weight of monofil standard polyester fibers, for example, together with the low-shrinkage dual-component fiber.

The nonwoven fabric according to the invention is preferably composed of low-shrinkage dual-component core-sheath fibers having a titer in the range between 0.1 and 15 dtex. The nonwoven fabric according to the invention has a weight per unit area between 20 and 500 g/m$^2$. For a weight per unit area of 150-190 g/m$^2$, for example, the nonwoven fabric according to the invention achieves a bending stiffness of greater than 1 Nmm transverse to the machine direction, as determined in accordance with ISO 2493.

The method for producing the thermally bonded nonwoven fabric is characterized in that the fibers are laid out to produce a nonwoven fabric, thermally bonded, and immediately compressed if necessary. In the method, the fibers of the nonwoven fabric according to the invention are placed in a thermal fusion oven which allows uniform temperature equilibration of the binding fibers. The low-shrinkage dual-component core-sheath fibers are preferably laid out wet in a paper layout process and dried, or laid out dry using a carding or airlaid process and then bonded at temperatures of 200 to 270° C., and optionally compressed using a calendar or press tool at rolling temperatures below the melting point of the sheath polymer, preferably <170° C. This compression is preferably carried out immediately after the bonding process in the dryer, when the fibers are still hot. However, the structure of the fibers also allows subsequent heat treatment, since the bonding process may be activated multiple times.

The thermally bonded nonwoven fabrics obtained have shrinkage and curl values in the range of <2%, preferably <1%.

The nonwoven fabrics according to the invention are suitable as a liquid filter medium, membrane support fleece, gas filter medium, battery separator, or nonwoven fabric for the surface of composite materials on account of their high thermal stability, low shrinkage tendency, and stability with regard to chemical aging. This is particularly true for use as an oil filter medium in motor vehicle engines.

The invention is explained in greater detail below with reference to the figures, which show the following:

TEST METHODS

Bending Stiffness

Figure 1:
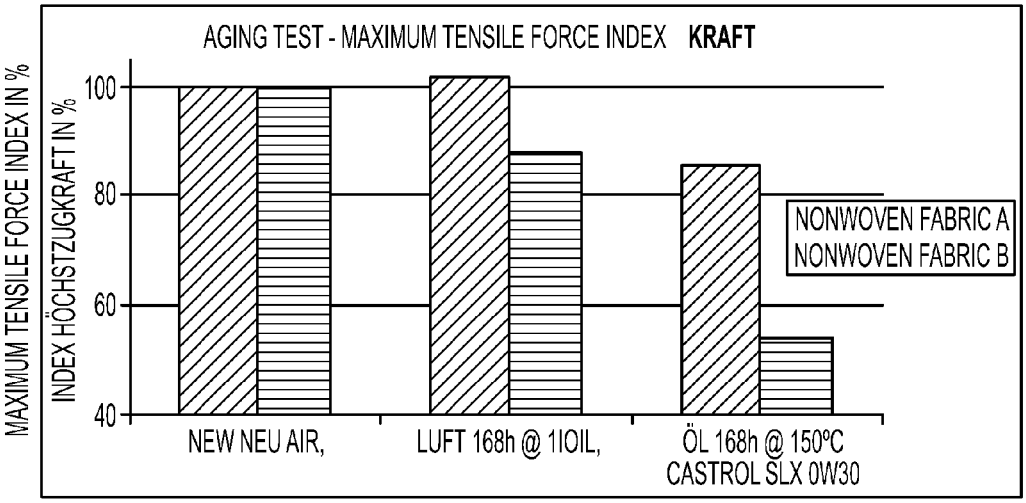
FIG. 1 shows a diagram illustrating the maximum tensile forces for nonwoven fabrics A and B in the form of an index, after storage in air and in oil, relative to the respective new state (DIN 53508 and DIN 53521)

The bending stiffness was determined in Nmm in accordance with ISO 2493.

Thermal Dimensional Change (Shrinkage)

The sample (DIN A4-size sample) was provided with marks 200 mm apart in the longitudinal and transverse directions. The samples were stored for 1 hour at 150° C. in a circulating air oven and then cooled for 20 minutes at room temperature, after which the dimensional change was determined. This value was expressed as a percentage of the starting value for the longitudinal and transverse directions. The algebraic signs preceding the percentage value indicate whether the dimensional change is positive (+) or negative (−). The mean value was determined from at least six individual values (measurements).

Thermal Dimensional Change (Curl)

The sample (DIN A4-size sample) was provided with marks at which the thickness was determined in accordance with ISO 9073/2. The samples were stored for 1 hour at 150° C. in a circulating air oven and then cooled for 20 minutes at room temperature, after which the thickness was predetermined at the marks (ISO 9073/2). The curl (B), expressed as a percentage, was calculated as follows:

$$B(\%)=(\text{Thickness after storage}\times 100/\text{Thickness before storage})-100$$

The mean value was determined from at least six individual values (measurements).

Testing of Hot-Air Shrinkage

Twenty individual fibers were tested. The fiber was provided with a pretensioning weight as described below. The free end of the fiber was placed in the clamp of a clamping plate. The length of the clamped fiber was determined ($L_1$). The fiber, freely suspended without weight, was then temperature-equilibrated for 10 minutes at 17° C. in a circulating air drying oven. After cooling for at least 20 minutes at room temperature the same weight from the determination of $L_1$ was suspended from the fiber again, and the new length ($L_2$) after the shrinkage process was determined.

The percentage of hot-air shrinkage was calculated from the following expression:

$$HS(\%)=(\Sigma L_1-L_2)*100/\Sigma L_1$$

TABLE 1

| Size of pretensioning weight | |
|---|---|
| Titer (dtex) | Pretensioning weight (mg) |
| ≦1.20 | 100 |
| >1.20 ≦1.60 | 100 |
| >1.60 ≦2.40 | 150 |
| >2.40 ≦3.60 | 200 |
| >3.60 ≦5.40 | 250 |
| >5.40 ≦8.00 | 350 |
| >8.00 ≦12.00 | 500 |
| >12.00 ≦16.00 | 700 |
| >16.00 ≦24.00 | 1000 |
| >24.00 ≦36.00 | 1500 |

In the freely suspended state the fiber should have an uncurled appearance. If the curl was too great, the next heavier weight was selected.

Heat of Fusion (DSC)

The sample was weighed in a DSC apparatus from Mettler Toledo and heated from 0° C. to 300° C. using a temperature program of 10° C./min. The area beneath the endothermic melting peak obtained, in conjunction with the original fiber weight and the associated masses of the sheath or core component, represents the heat of fusion of the respective component in J/g.

EXAMPLE 1

Nonwoven fabric A represents a dry-laid, carded, and thermally bonded nonwoven fabric having a weight per unit area of 190 g/m$^2$. This nonwoven fabric was composed of 75% low-shrinkage PET/PBT dual-component fiber having a sheath melting point of 225° C. and a core-to-sheath ratio of 50:50, and up to 25% conventional PET fibers. The thickness was 0.9 mm, and the air permeability was 850 L/m$^2$s at 200 Pa. 140 g/m$^2$ of the fibers were carded by combing using a cross-layer, and the remaining 50 g/m$^2$ were carded in a longitudinal layout. The nonwoven fabric was bonded in a thermal fusion oven at approximately 240° C., and was calibrated to the target thickness using an outlet press tool.

COMPARATIVE EXAMPLE

Nonwoven fabric B was produced analogously as for nonwoven fabric A. The differences consisted in use of conventional PET/CoPET dual-component fibers having a sheath melting point of approximately 200° C., and reduction of the oven temperature to 230° C. The resulting weight per unit area, thickness, and air permeability were comparable.

Figure 2:
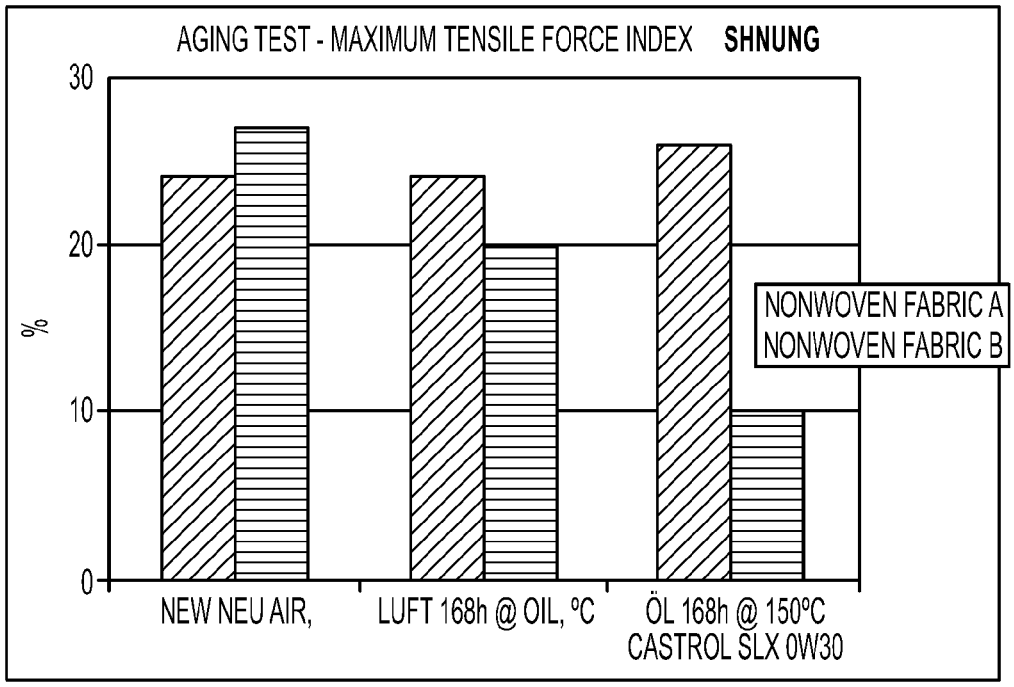
FIG. 2 shows a diagram illustrating the maximum tensile force elongation for nonwoven fabrics A and B after storage at 150° C. in air and in oil, relative to the respective new state (DIN 53508 and DIN 53521)
Figure 3:
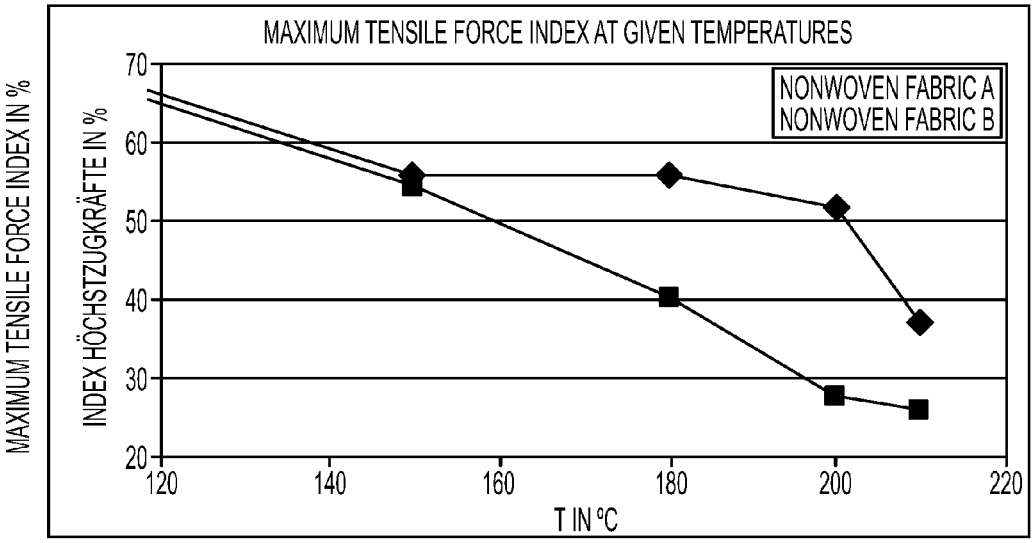
FIG. 3 shows a diagram illustrating the maximum tensile forces for nonwoven fabrics A and B at various temperatures in the form of an index, relative to the respective new state (DIN EN 29073-03)

The advantages of nonwoven fabric A according to the invention compared to nonwoven fabric B are as follows:

- The width of the nonwoven fabric after the dryer decreased by only about 9% for nonwoven fabric A, whereas a loss in width of approximately 21% occurred for nonwoven fabric B.
- The transverse bending stiffness for nonwoven fabric was 15% greater.
- The increase in thickness after storage at 150° C. (thermal dimensional change) for nonwoven fabric A was 1.5%, and for nonwoven fabric B, 4.7%.
- The thermal and chemical stability for storage at 150° C. in air and in oil was much better for nonwoven fabric A (FIGS. 1 and 2). The diagrams clearly show greater destruction of nonwoven fabric B when stored in motor oil. In particular, the brittleness in FIG. 3 indicates a problem with the chemical stability of nonwoven fabric B in oil.
- The maximum tensile forces at various temperatures show a much more favorable progression for nonwoven fabric A (FIG. 3).

EXAMPLE 2

Nonwoven fabrics C and D represent wet-laid, dried, and thermally bonded nonwoven fabrics having a weight per unit area of 198 g/m$^2$ and 182 g/m$^2$, respectively. These nonwoven fabrics were composed of 72% low-shrinkage PET/PBT dual-component fiber having a sheath melting point of 225° C. and a core-to-sheath ratio of 50:50, and up to 28% conventional PET fibers. The fibers were present as dispersible short-cut fibers. The fibers were deposited on a screen belt in the paper-laying process, dried, and thermally bonded in a second dryer. The exceptional properties of these nonwoven fabrics consisted in the very good mechanical test values and excellent shrinkage characteristics (Table 2). In this case a comparison could not be made to nonwoven fabrics composed of conventional dual-component fibers having a CoPET sheath, since on account of the high shrinkage values it has not been possible heretofore to use such fibers on this nonwoven fabric apparatus; i.e., the fibers exhibited reductions in width of at least 20%. The wet nonwoven fabrics according to the invention exhibited reductions in width of approximately 3%.

TABLE 2

Test values for nonwoven fabrics C and D

| | Nonwoven fabric C | Nonwoven fabric D |
|---|---|---|
| Weight per unit area | 198 g/m$^2$ | 182 g/m$^2$ |
| Thickness | 1.10 mm | 0.99 mm |
| Air permeability | 714 L/m$^2$s | 796 L/m$^2$s |
| Maximum longitudinal tensile force | 536 N/5 cm | 446 N/5 cm |
| Maximum transverse tensile force | 358 N/5 cm | 329 N/5 cm |
| Longitudinal bending stiffness | 2.5 Nmm | 1.9 Nmm |
| Transverse bending stiffness | 2.1 Nmm | 1.6 Nmm |
| Longitudinal shrinkage at 150° C., 1 h | 0.0% | 0.3% |
| Transverse shrinkage at 150° C., 1 h | 0.0% | 0.0% |
| Curl at 150° C., 1 h | 0.7% | 1.5% |

The low-shrinkage dual-component fibers according to the invention offer advantages, in particular for use in the wet-laying process employing separate dryers for water removal and for thermal fusion, since in contrast to undrawn binding fibers these fibers may be activated multiple times, i.e., are not completely reacted upon the first drying process.

Nonwoven fabrics A, C, D according to the invention are particularly suited for use as motor oil filter media in motor vehicles.

EXAMPLE 3

Figure 4:
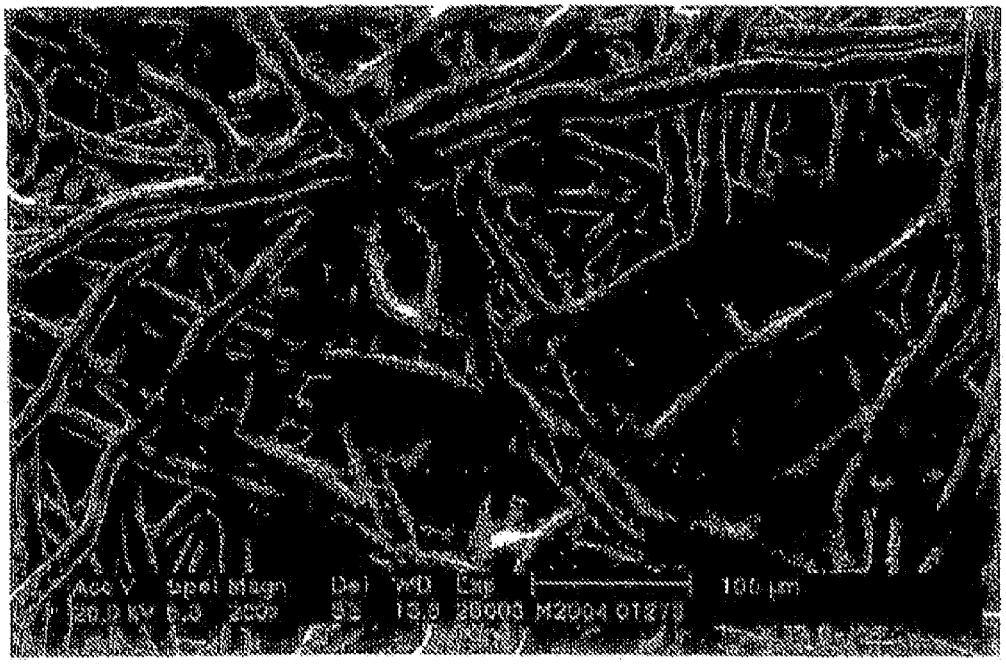
FIG. 4 shows an electromicrograph of a membrane support fleece bonded with undrawn polyester fibers (nonwoven fabric E; comparative example)
Figure 5:
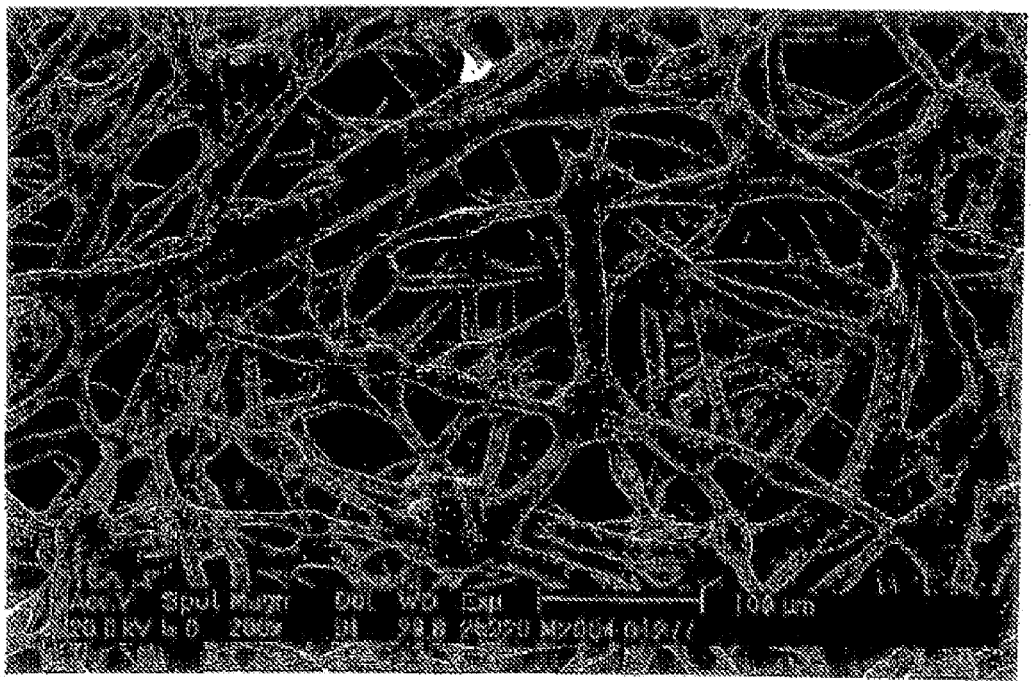
FIG. 5 shows an electromicrograph of a membrane support fleece which according to the invention is composed of 100% low-shrinkage PET/PBT dual-component fiber (nonwoven fabric F)

For use as membrane support fleeces, calendared PET nonwoven fabrics (comparative example; nonwoven fabric E) composed of a mixture of drawn and undrawn monofil PET fibers represent prior art. As a result of the calendaring process, there is a risk of surface sealing in particular for heavy nonwoven fabrics having weights per unit area >150 g/m$^2$, since for good bonding of the nonwoven fabric high rolling temperatures or slow production speeds are required in order to conduct the necessary heat to the interior of the nonwoven fabric. Sealed surfaces entail the risk of film formation, which in turn results in poor membrane adhesion and lower flow rates (comparative nonwoven fabric E). FIGS. 4 and 5 demonstrate the difference in surfaces for a conventional nonwoven fabric (comparative example; nonwoven fabric E; FIG. 4) and for a nonwoven fabric according to the invention (nonwoven fabric F; FIG. 5).

The complete absence of surface sealing for nonwoven fabric F (FIG. 5) is also shown in a comparison of test values for the two nonwoven fabrics. The air permeability of nonwoven fabric F increased by an order of magnitude, whereas the other test values were comparable (Table 3).

TABLE 3

Test values for nonwoven fabrics E and F

| | Nonwoven fabric C | Nonwoven fabric D |
|---|---|---|
| Weight per unit area | 190 g/m$^2$ | 190 g/m$^2$ |
| Thickness | 0.26 mm | 0.25 mm |
| Air permeability (200 Pa) | 5 L/m$^2$s | 41 L/m$^2$s |

TABLE 3-continued

| Test values for nonwoven fabrics E and F | | |
|---|---|---|
| | Nonwoven fabric C | Nonwoven fabric D |
| Maximum longitudinal tensile force | 520 N/5 cm | 514 N/5 cm |
| Maximum transverse tensile force | 470 N/5 cm | 560 N/5 cm |

Use of conventional dual-component fibers containing copolymers in the sheath has not become established in this application area due to the high shrinkage values and the associated weight fluctuations, in addition to the frequent denial of food safety authorization for sheath polymers. The nonwoven fabrics according to the invention, composed of the corresponding dual-component fibers, overcome both drawbacks, since they are low-shrinkage and pose no difficulties in food safety authorization because they are composed of homopolymers.

EXAMPLE 4

Figure 6:
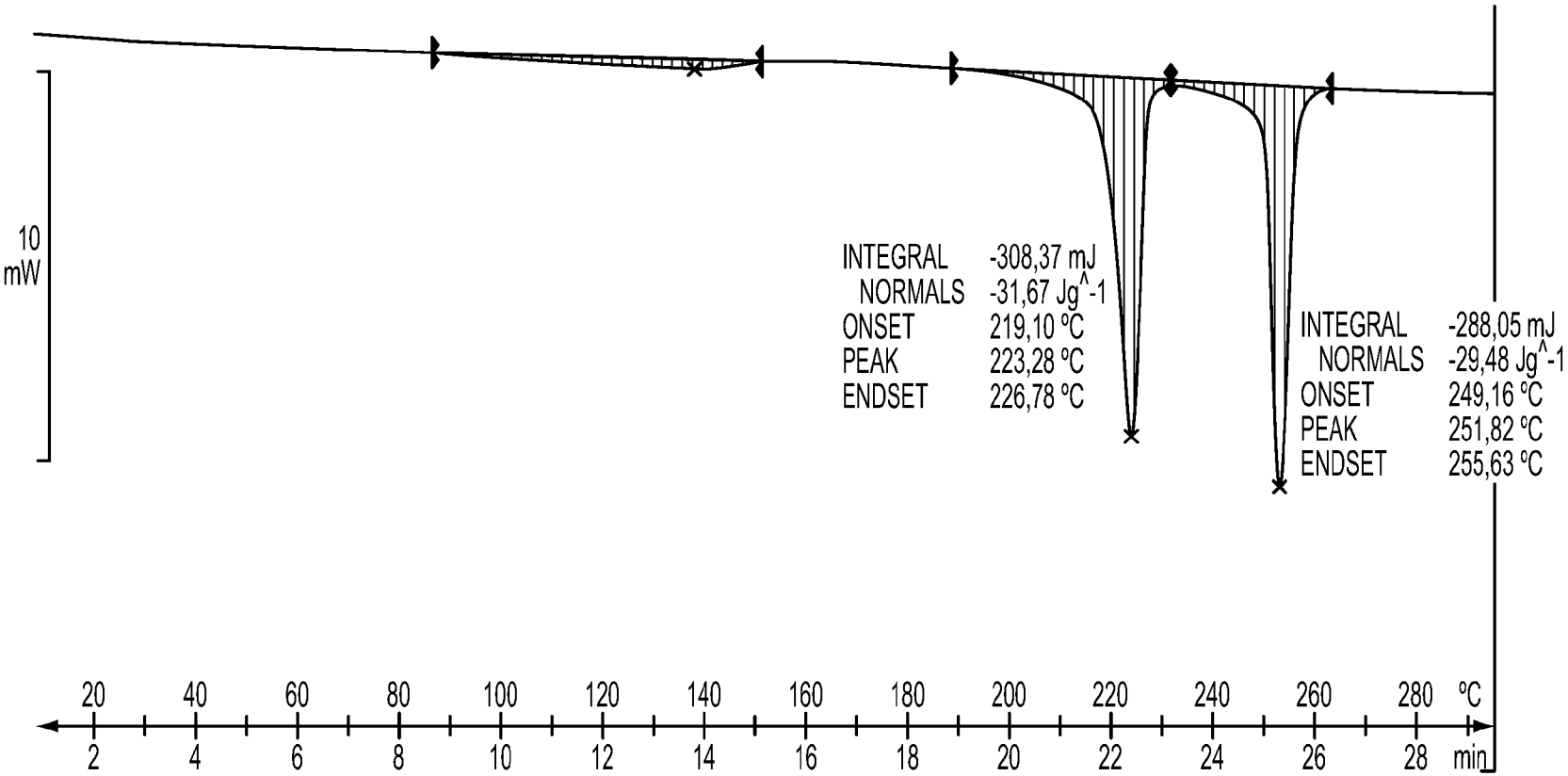
FIG. 6 shows a DSC curve for a dual-component fiber A containing crystalline sheath polymer (in this case PET/PBT; according to the invention)
Figure 7:
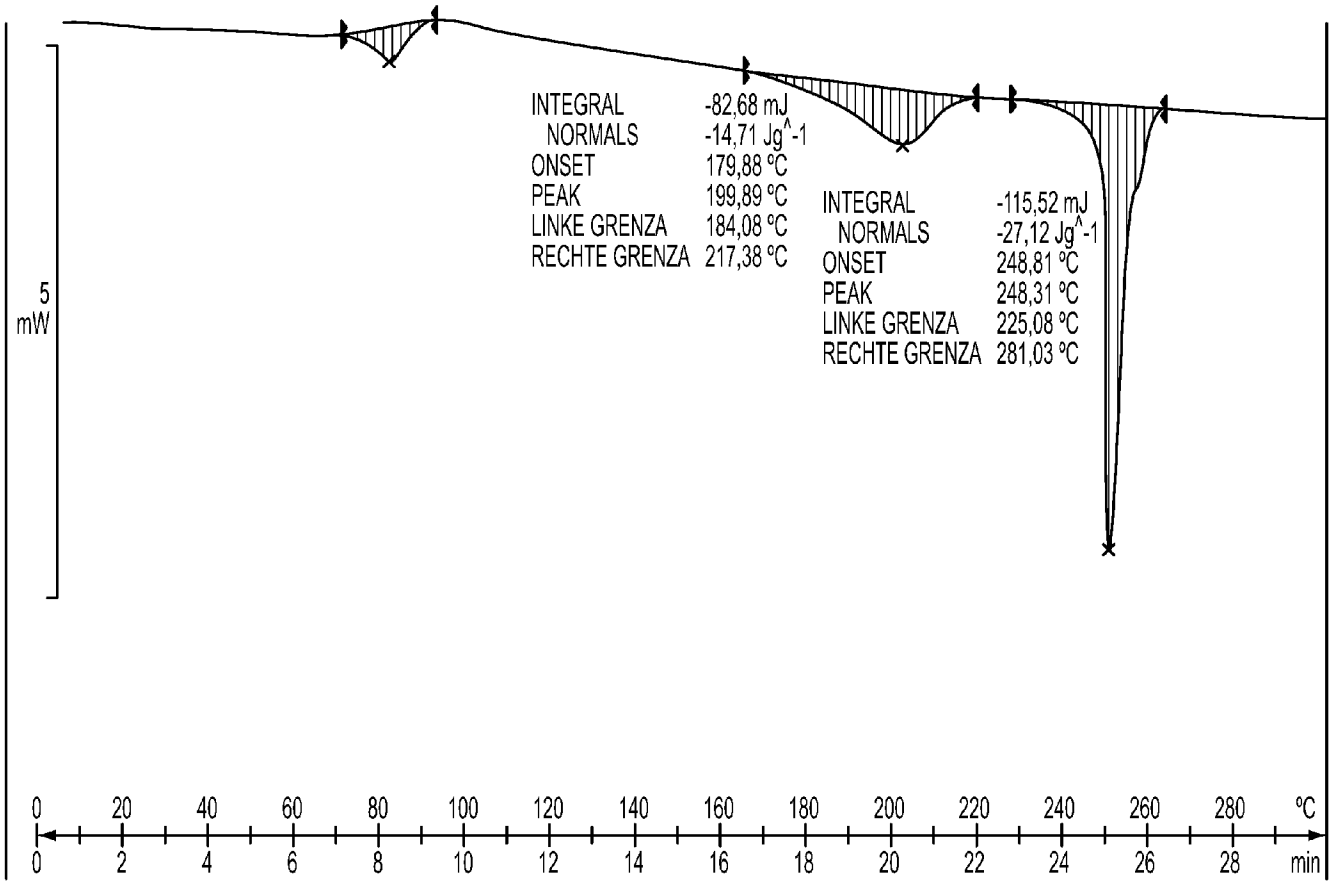
FIG. 7 shows a DSC curve for a dual-component fiber B containing amorphous sheath polymer (in this case PET/coPET; prior art).

To further demonstrate the differences in the nonwoven fabrics according to the invention compared to conventional nonwoven fabrics containing dual-component fibers having sheaths based on copolymers, FIGS. 6 and 7 show a comparison of differential scanning calorimetry (DSC) curves for fibers containing crystalline sheath polymer (fiber A; in this case PBT) to DSC curves for conventional dual-component fibers (fiber B; in this case CoPET). The analysis of the heats of fusion of the lower-melting component showed that the sheath for fiber B has a much lower heat of fusion, in J/g, than fiber A.

The heat of fusion is a direct measure of the crystalline fractions in the polymer. The core-to-sheath ratios in both fibers were 1:1, resulting in the following heats of fusion for the fiber sheaths:

| | |
|---|---|
| Fiber A | 63 J/g |
| Fiber B | 29 J/g |

Here as well, the core of both fibers, which in each case is composed of PET, may be used as a measurement reference. The values obtained for the heat of fusion are comparable (59 J/g versus 54 J/g).

Independent of the measured values, in a comparison of the DSC curves the low peak height and the wider peak base are characteristic of fiber sheaths based on copolymers (in this case CoPET). The melting point as well as the crystallinity, i.e., the tendency of the polymers to crystallize, are reduced by incorporation of comonomers such as isophthalic acid into polyethylene terephthalate.

The nonwoven fabrics according to the invention are therefore based on fibers of the fiber A type.

What is claimed is:

1. A thermally bonded nonwoven fabric comprising:

low-shrinkage dual-component core-sheath fibers, said low-shrinkage dual-component core-sheath fibers comprising:

a crystalline polyester core consisting of polyethylene terephthalate (PET) or polyethylene naphthalate (PEN) and a crystalline polyester sheath consisting of polybutylene terephthalate (PBT), polytrimethylene terephthalate (PTT), or polyethylene terephthalate (PET), the sheath having a melting point at least 10° C. lower than the core, the heat-shrinkage of the fiber being less than 10% at 170° C., wherein said sheath polyesters have a heat of fusion of >40 J/g and a width at the base of the sheath melting peak via Differential Scanning Calorimetry occurring within <40° C. at 10° C/minute, wherein the sheath of the low-shrinkage dual-component core-sheath fiber comprises >95% of a homogeneous polyester polymer which is not a copolymer; and monofilament polyester fibers;

wherein:

the low-shrinkage dual-component core-sheath fibers have a titer between 0.1 and 15 dtex;

the non-woven fabric has a weight per unit area between 20 and 500 g/m$^2$;

the low-shrinkage dual-component core-sheath fiber has a core-to-sheath ratio between 10:90 and 90:10; and after 1 h at 150° C. said nonwoven fabric exhibits a thermal dimensional change of <2%.

2. The nonwoven fabric according to claim 1, wherein the sheath of the low-shrinkage dual-component core-sheath fibers is composed of polybutylene terephthalate (PBT) or polytrimethylene terephthalate (PTT) or polyethylene terephthalate (PET).

3. The nonwoven fabric according to claim 1, wherein the core of the low-shrinkage dual-component core-sheath fibers is composed of polyethylene terephthalate (PET) or polyethylene naphthalate (PEN).

4. The nonwoven fabric according to claim 1, wherein the low-shrinkage dual-component core-sheath fibers has a core-to-sheath ratio of about 50.

5. The nonwoven fabric according to claim 1, wherein said nonwoven fabric contains greater than 0 to 90% by weight of one or more additional fibers.

6. The nonwoven fabric according to claim 1, wherein the nonwoven fabric is laid out wet.

7. The nonwoven fabric according to claim 1, wherein for a weight per unit area >150 g/m$^2$ said nonwoven fabric has a transverse bending stiffness >1 Nmm.

8. The nonwoven fabric according to claim 1, wherein after 1 h at 150° C. said nonwoven fabric exhibits a thermal dimensional change of<1%.

9. A product comprising a thermally bonded nonwoven fabric containing:

a low-shrinkage dual-component core-sheath fiber composed of a crystalline polyester core and a crystalline polyester sheath the sheath having a melting point at least 10° C. lower than the core, the heat-shrinkage of the fiber being less than 10% at 170° C., wherein the sheath of the low-shrinkage dual-component core-sheath fiber comprises >95% of a homogeneous polyester polymer which is not a copolymer, and monofilament polyester fibers wherein said product is selected from the group consisting of a liquid filter medium, membrane support fleece, gas filter medium, battery separator, or nonwoven fabric for the surface of composite materials.

10. The nonwoven fabric according to claim 9, wherein the nonwoven fabric is laid out dry.

* * * * *